United States Patent [19]

Welton et al.

[11] 4,302,157

[45] Nov. 24, 1981

[54] HIGH FLUID LEVEL PUMP OFF CONTROLLER AND PROCESS

[75] Inventors: Barry S. Welton; G. Wayne Westerman, both of Midland, Tex.

[73] Assignee: End Devices, Inc., Midland, Tex.

[21] Appl. No.: 9,238

[22] Filed: Feb. 5, 1979

[51] Int. Cl.[3] ..... F04B 49/02

[52] U.S. Cl. ..... 417/12; 417/44; 417/53; 318/474

[58] Field of Search ..... 417/12, 22, 23, 24, 417/42, 43, 44, 53; 318/474

[56] References Cited

U.S. PATENT DOCUMENTS

| | | | |
|---|---|---|---|
| 2,707,440 | 5/1955 | Long et al. | 417/12 |
| 3,075,466 | 1/1963 | Agnew et al. | 417/12 |
| 3,269,320 | 8/1966 | Tilley et al. | 417/12 |
| 3,817,094 | 6/1974 | Montgomery et al. | 73/151 |
| 4,058,757 | 11/1977 | Welton et al. | 73/133 R X |
| 4,118,148 | 10/1978 | Allen | 417/12 |
| 4,171,185 | 10/1979 | Duke et al. | 417/12 |

*Primary Examiner*—Christopher K. Moore
*Attorney, Agent, or Firm*—Arthur F. Zobal

[57] ABSTRACT

A process and system for distinguishing between actual and false pump off of a well and for shutting in the well only upon the occurrence of actual pump off. The process and system employs the principle that pump off may occur only after a not pumped off condition has been detected.

8 Claims, 6 Drawing Figures

LOAD TRANSDUCER
301
POSITION TRANSDUCER
303
305
309
Zero
AMPLIFIER
Span
Zero
AMPLIFIER
Span
Load Signal
307
INTEGRATOR
Reference Position Signal
Work Signal
LOAD RANGE DETECTOR
319
LEVEL DETECTOR
311
Reset
317
DELAY
321
DELAY
313
NOT PUMPED OFF COUNTER
Disable
Start Time
318
Shut Down
SHUT DOWN CONTROL
315
Restart
DOWN TIMER
To Pump Motor Relay
Enable Counter (Reset)
Enable

HIGH FLUID LEVEL PUMP OFF CONTROLLER AND PROCESS

BACKGROUND OF THE INVENTION

1. Field of the Invention

The present invention relates to a process and system for controlling the operation of the pump of a well.

2. Description of the Prior Art

U.S. Pat. Nos. 4,058,757, 3,953,777, 3,778,694, and 3,075,466 disclose and refer to pump off controllers for shutting down the pump of a well if a pumped off condition occurs. By pumped off is meant that the fluid level in the well drops such that the pump is not lifting as much fluid and, hence, the amount of work done by the pump decreases. Continued pumping under pumped off conditions may result in damage to the equipment. Thus, the pump is shut down for a time period sufficient to allow the fluid level to raise to a desired pumping level.

It has been observed that another condition other than a pumped off condition can occur in a well wherein the amount of work done by the pump is reduced from normal. In many cases, particularly in secondary recovery projects, protracted shut in periods of pumping systems will allow the fluid level to rise to a point that will reduce the amount of work at the polished rod sufficiently to make the well seem to be pumped off. The high fluid level essentially makes the well shallower. The pump is required to lift less head and, hence, the work done by the pump is reduced. This is not a condition where one desires to shut down the pump but rather a condition where one wants to continue pumping.

Present day pump controllers which look at the load on the pump or the amount of work done by the pump cannot distinguish this high fluid level condition or false pumped off condition from an actual pumped off condition. Thus, if a high fluid level is present upon start up, the controller will detect the false pumped off condition and shut the well in allowing the fluid level to raise further.

In order to allow the pumping system to automatically pump down the high fluid level and continue to operate in a normal manner, some provision must be made to distinguish between a high fluid level condition and an actual pumped off condition and to shut the well in only upon the occurrence of an actual pumped off condition.

SUMMARY OF THE INVENTION

It is an object of the present invention to provide a process and system for distinguishing between false pump off and actual pump off in order to prevent premature shut down due to anomalies not associated with actual pump off.

It is a further object of the present invention to provide a process and system for shutting in a well only upon the occurrence of actual pump off and which employs the principle that pump off may occur only after a not pumped off condition has occurred.

DESCRIPTION OF THE PREFERRED EMBODIMENTS

Figure 1:
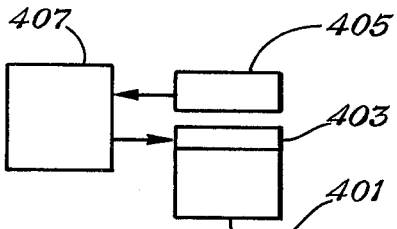
FIG. 1 is a block diagram of a system for carrying out the process of the present invention and which may be a local analog logic system or a computer employing soft ware.

Referring now to FIG. 1, there is depicted a well 401 having a pump 403 for pumping oil and other fluids from the under ground formations to the surface. The pump preferably is of the walking beam type driven by an electric motor. Reference is made to U.S. Pat. No. 3,817,094 for a brief description and drawing of such a pump. A transducer 405 is employed for measuring the current drawn by the motor or for measuring the load on the pump during its stroke cycles. A current transducer and a load transducer for obtaining such measurements are disclosed in U.S. Pat. No. 4,058,757. The output of the transducer 405 is applied to a system 407 which may be a local analog logic system at the well or a computer at a distant location operated by soft ware. The system 407 distinguishes between actual and false pump off and shuts in the well only upon the occurrence of actual pump off. It employs the principle that actual pump off may occur only after a not pumped off condition has occurred.

Figure 2:
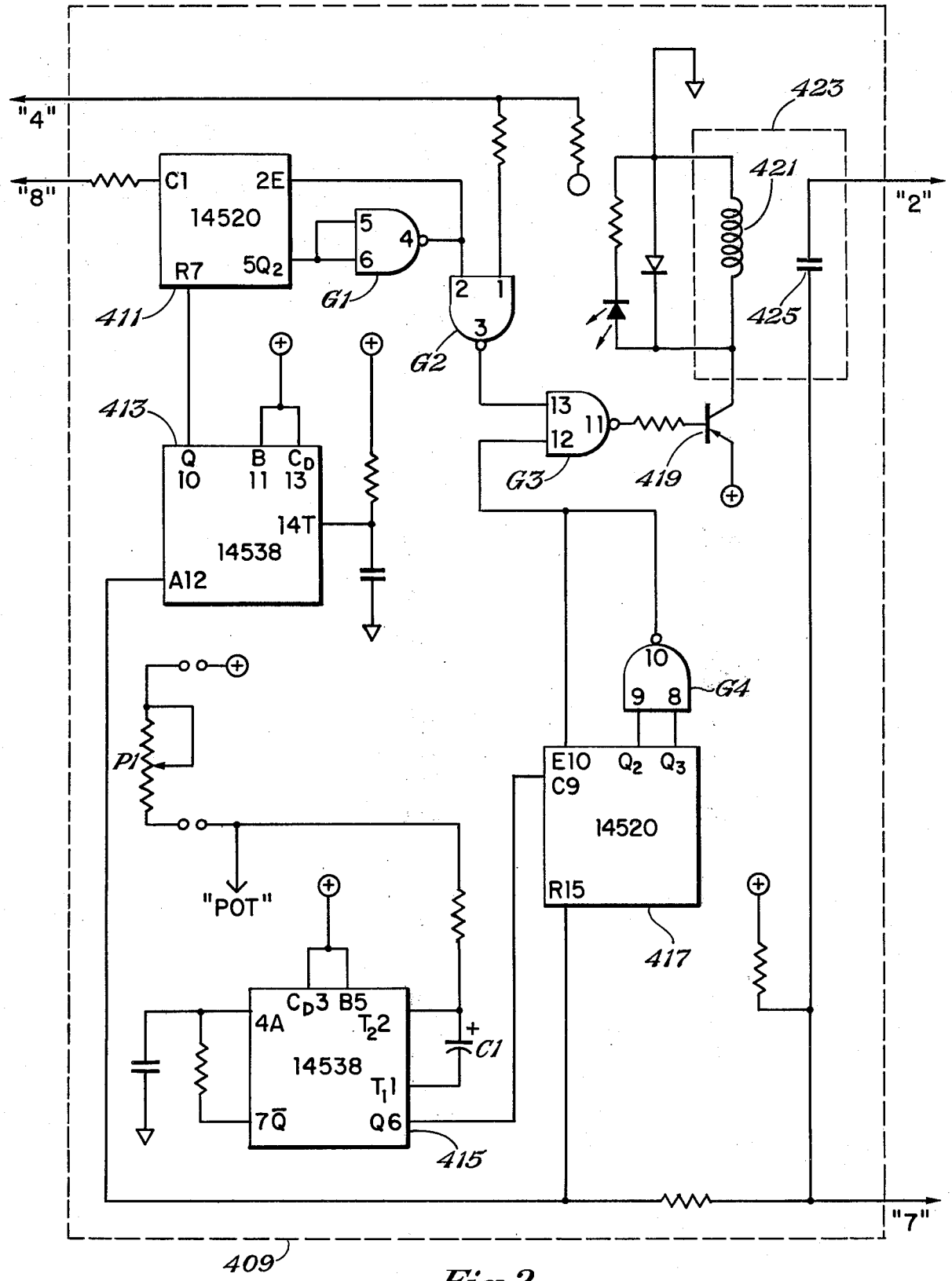
FIG. 2 is a schematic diagram of circuitry which forms part of the present invention.

A local analog logic system which may be employed for carrying out the process of the present invention comprises the circuitry 409 of FIG. 2 of the present application used in combination with either of the pump off controllers of U.S. Pat. No. 4,058,757. In this patent, one controller is described with reference to FIGS. 1–10 thereof and the other controller is described with reference to FIGS. 11–13. The specification and drawings of U.S. Pat. No. 4,058,757 are incorporated by reference into the present application for a detailed description of the controllers.

Figure 3:
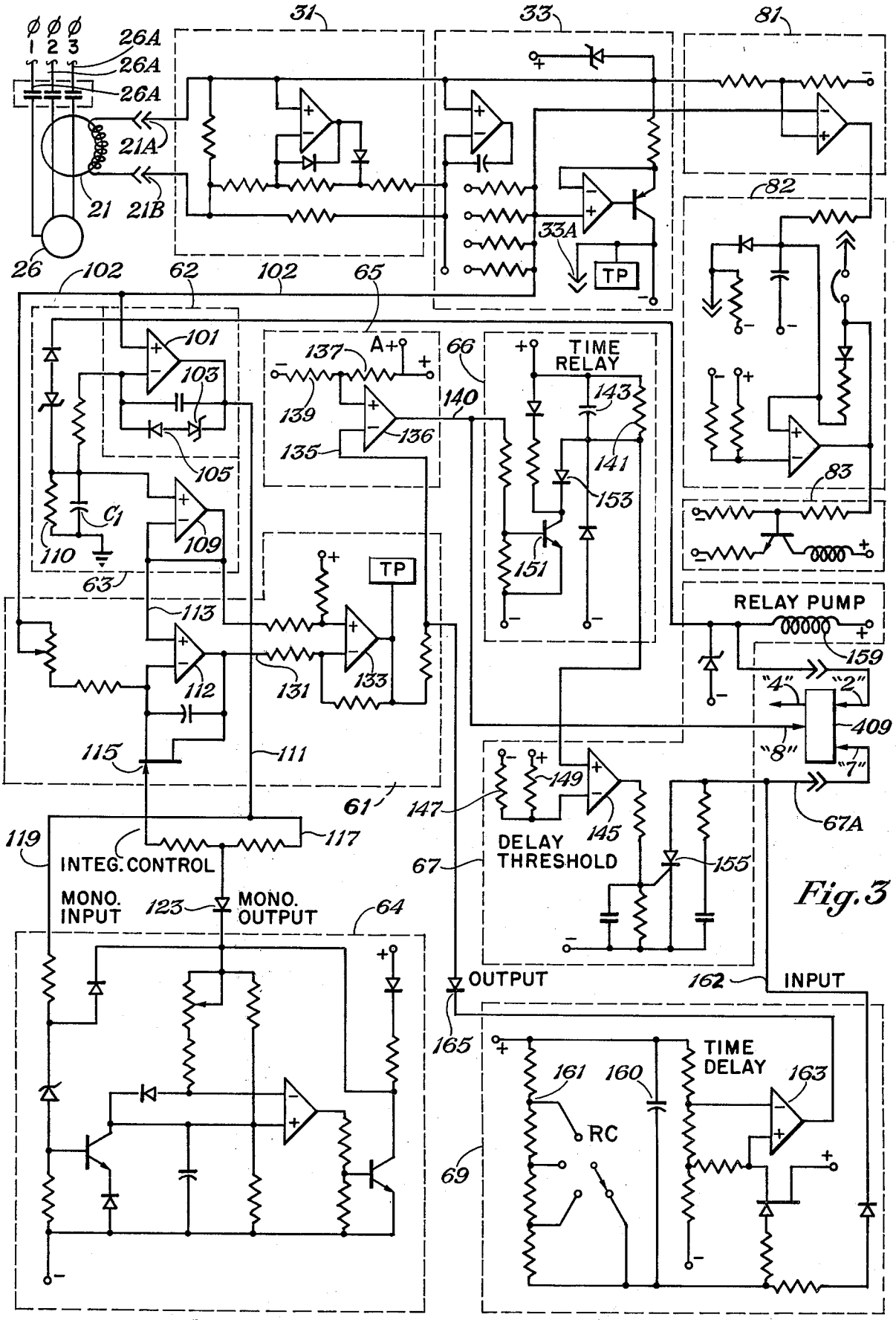
FIG. 3 illustrates one embodiment of the pump off controller of U.S. Pat. No. 4,058,757 with the circuitry of FIG. 2 incorporated therein.

FIG. 3 of the present application illustrates the manner in which circuitry 409 may be employed with the controller of FIGS. 1–10 of U.S. Pat. No. 4,058,757. FIG. 3 of the present application is a reproduction of FIGS. 2A and 2B of U.S. Pat. No. 4,058,757 with the circuitry 409 shown substituted for the downtimer 68. As shown in FIG. 3 of the present application, input pin "8" of circuitry 409 is connected to conductor 140 leading from operational amplifier 136 of trip circuit 65. Input pin "7" of circuitry 409 is connected to the output pin 67A of control circuit 67 and the output pin "2" is connected to motor pump relay 159.

In the system of FIG. 3 of the present application, a current transducer 21 is employed for measuring the current drawn by the pump motor during the operation of the pump. The output of transducer 21 is rectified by rectifier 31, amplified at 33, and applied to integrator 61 and peak picker 62. The peak picker 62, sample and hold 63 and monostable multivibrator 64 act together to control the integrator 61 to allow it to integrate the output of the amplifier 33 over each complete cycle of the walking beam which includes both the up stroke and the down stroke. The output of integrator 61, illustrated in FIG. 7 of U.S. Pat. No. 4,058,757, is applied to a level trip 65 which sets a threshold as illustrated at 91 in this same figure. The circuitry is adjusted and calibrated such that when the pump is pumping normally, the integrated output of integrator 61 reaches the threshold 91 during each stroke cycle and which threshold is representative of a given amount of work done by the pump. If the work performed by the pump decreases, the integrated output decreases until it no longer reaches the threshold. If the integrated output is below the threshold, then either a high fluid level is present or a pumped off condition has occurred.

When the integrated output reaches the threshold during each stroke cycle, a positive pulse is produced during each cycle by operational amplifier 136 of the level trip 65. The positive pulse resets a timing circuit 66 during each stroke cycle which causes a control circuit 67 to have a high output at the output pin 67A extending from the anode of SCR 155. If the integrated output of integrator 61 does not reach the threshold, operational amplifier 136 of the level trip 65 does not produce the positive pulses and the timing circuit is not reset. In addition, the output at pin 67A goes low.

Thus, under normal pumping conditions, positive pulses are applied to pin "8" of circuit 409 and a high is applied to pin "7". For purposes of the following description, these positive pulses will be referred to as not pumped off pulses. If the work done by the pump decreases below the preset threshold level due to a pumped off condition or due to a high fluid level, the positive pulses are not applied to pin "8" of circuit 409 and the input to pin "7" goes low.

Reference now will be made to FIG. 2 for a detailed description of the manner of operation of circuit 409. In this circuit, 411 is a not pumped off counter; 413 is an oscillator which acts as a not pumped off reset timer; 415 is an oscillator; and 417 is a down time counter for counting the output pulses of oscillator 415. The rate of oscillation of oscillator 415 is determined by resistor P1 and capacitor C1. Each of counters 411 and 417 are commercially available integrated circuit counters identified in the industry as a 14520. They may be purchased from Motorola. They are defined as a binary four bit up counter that can be enabled. Each of oscillators 413 and 415 are commercially available intergrated circuit oscillators identified in the industry as a 14538. They are defined as a triggered monostable oscillator. Gates G1, G2, G3 and G4 and NAND gates and 419 is a transistor which controls coil 421 of relay 423 for opening or closing contacts 425. Gates G1, G2, G3 and G4 each require two high inputs to obtain a low output. A low on any input results in a high output.

When contacts 425 are closed, the circuit 409 is enabled or armed and a current flow path is provided from pin "7" to pin "2". Under these conditions, if a low voltage is applied to pin "7", the pump motor relay 159 can be energized to shut down the pump motor and, hence, the pump. If contacts 425 are open, the pump motor relay 159 cannot be energized and hence cannot shut down the pump. Prior to start up of the pump motor, coil 421 will be deenergized and contacts 425 will be open.

Before the contacts 425 can be closed, the circuit 409 must receive four not pumped off pulses at pin "8". Thus, if the pump is restarted with a high fluid level in the well, the circuit 409 cannot be enabled until the well is pumped down and the four not pumped off pulses are received. When these four not pumped off pulses are received, contacts 425 will be closed and the circuit will be enabled or placed in a condition capable of shutting down the pump if an actual pumped off condition occurs. Thus, upon start up, the system requires a not pumped off condition to occur before the well can be shut down thereby preventing a high fluid level or false pump off from prematurely shutting the well down.

A detailed description of the operation of circuit 409 now will be given. When the circuit 409 is used to distinguish between false and and actual pump off, the input to pin "4" will be high. In the operation of counter 411, pin Q2 will go high only after four not pumped off pulses are applied to pin "8". Assume that the pump is restarted with a high fluid level in the well. The down timer 417 will be disabled. The input to pin 12 of gate G3 will be high. Four not pumped off pulses have not been received at pin "8" and the input to pin "7" is low. Thus, the inputs to pins 5 and 6 of gate G1 are low and output of pin 4 of gate G1 is high. The input to pin "4" is high. Thus, the output on pin 3 of gate G2 is low. The input to pin 13 of gate G3 is low whereby the output on pin 11 of gate G3 is high. Transistor 419 will be off and the relay 423 will deenergized whereby its contacts 425 will be open. Thus, pump off will not be acknowledged should it be issued from the system of FIG. 3.

The high fluid level in the well will be pumped down. As it is pumped down, the work performed by the pump begins to increase. When it reaches the preset threshold, positive not pumped off pulses will be produced and applied to pin "8" and the input to pin "7" will go high. Each of the not pumped off pulses will be counted by the counter 411. After four of these pulses have been received, the output on pin Q2 of counter 411 will go high. The output on pin 4 of gate G1 will go low whereby the input to pin 2 of gate G2 will go low. The output on pin 3 of gate G2 will go high. Thus, the inputs to both pins 12 and 13 of gate G3 will be high and output on pin 11 of gate G3 will go low. Transistor 419 will turn on and the relay 423 will be energized, closing contacts 425. The circuit 409 will be placed in an enabled condition and a pump off request (a low on pin "7") issued by the system of FIG. 3 will be acknowledged. When the output on pin 4 of gate G1 goes low it disables counter 411, preventing it from counting any more not pumped off pulses.

At some point in time, the well will go to an actual pumped off condition. When this occurs, the system will issue a pump off request applying a low to pin "7". This low is applied to the pump motor relay 159 through closed contacts 425 to shut the pump motor down. Pin "7" going low also has triggered the reset timer 413 which resets the not pumped off counter 411. The input on pin "7" having been high during the not pumped off condition of the well, will have held the down timer 411 at reset. Oscillator 415 has been running continuously and applying counts to the down time counter 417 which has been ignoring them since it has been held in a reset condition. The down timer 417 no longer being held in a reset condition will accept these counts. The down timer 417 will be incremented until it reaches a count of 12. This may require a time of from 15 seconds to 60 minutes, depending on the adjustment made to resistor P1. When the down timer reaches the count of 12, its Q2 and Q3 outputs will force the output on pin 10 of gate G4 low. This low will disable the down timer and be applied to pin 12 of gate G3. When the down timer is disabled, it will ignore any more counts from oscillator 415. The low on pin 12 of gate G3 insures that the output on pin 11 of gate G3 will go high. The transistor 419 will turn off, deenergizing relay 423 and opening contacts 425. This will terminate the down time and the pump motor will operate again whereby the pump will return to the normal run condition. Pin "7" will go high and the down timer 417 will be reset preparing it for another cycle.

Figure 4:
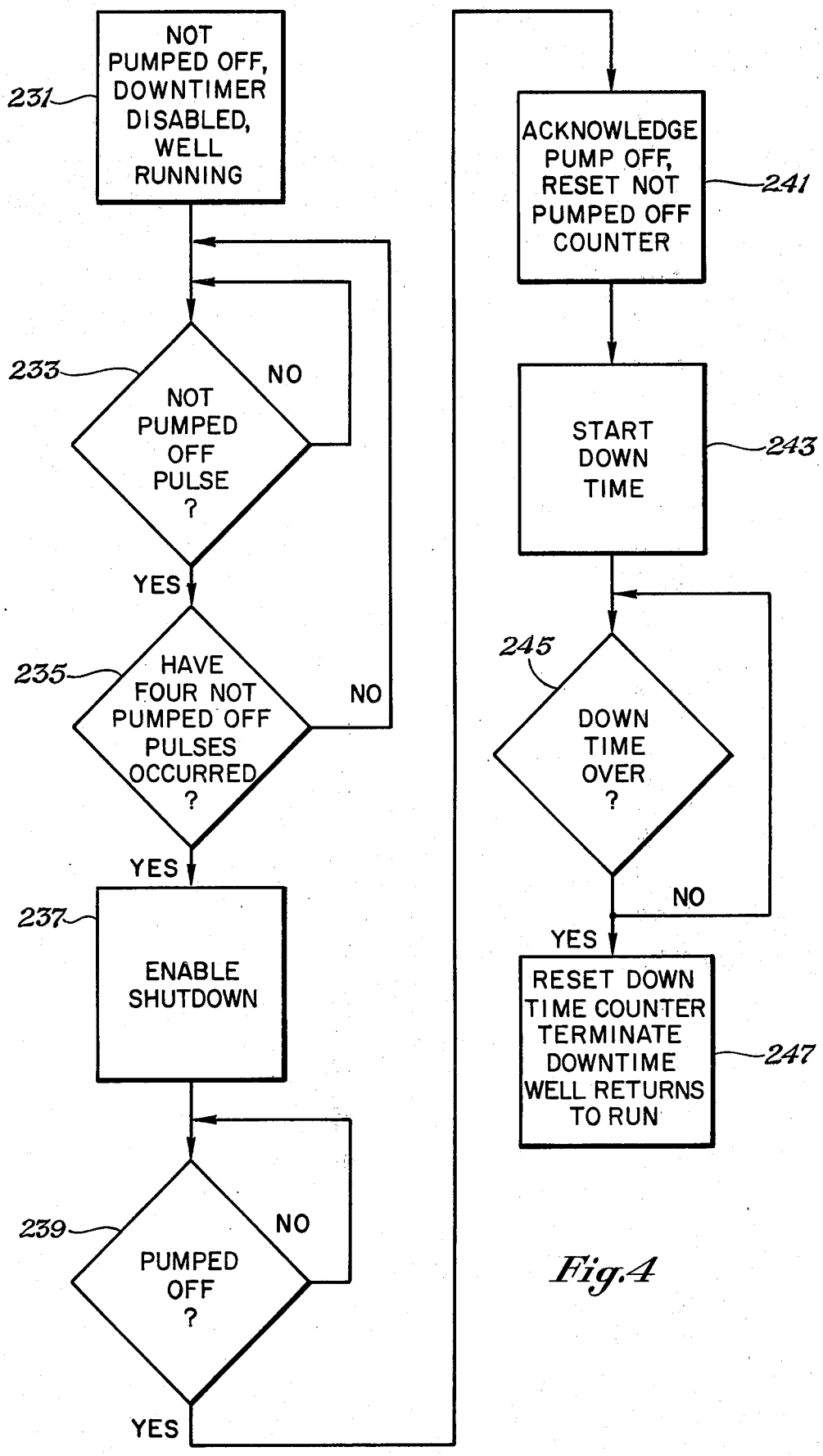
FIG. 4 is a flow diagram of the operation of the circuitry of FIG. 2 incorporated in the pump off controllers disclosed in U.S. Pat. No. 4,058,757. It also is a flow diagram of the logic process carried out with soft ware in a computer.

The flow chart of FIG. 4 illustrates the basic steps of the process that the system of FIGS. 2 and 3 go through. The first block 231 indicates that the well is not pumped off, the down timer 417 is disabled, and the pump is operating. Block 233 determines whether the system is producing not pumped off pulses. If not, it cycles back until not pumped off pulses are produced. This allows the pump to continue running until the high fluid level is pumped down. Block 235 determines whether four not pumped off pulses have been produced. If not, it cycles back until they are produced. When this occurs, block 237 enables the system for shut down. Block 239 determines if the well is pumped off. If not, it cycles back. When the well pumps off, block 241 acknowledges pump off to shut the well down and resets the not pumped off counter 411. Block 243 starts the down time. Block 245 determines whether the down time is over. If not, it cycles back. When the down time is over, block 247 resets the down time counter, terminates down time, and returns the well to the run condition.

The process, as illustrated in FIG. 4, also can be carried out with the circuit of FIG. 2 employed in the embodiment of FIGS. 11–13 of U.S. Pat. No. 4,058,757. When employed in this embodiment, pin "8" will be connected to the output of operational amplifier 255 (see FIG. 12A of U.S. Pat. No. 4,058,757) and pin "7" will be connected to conductor 270 (see FIG. 12B of U.S. Pat. No. 4,058,757). The down timer 68 will not be employed and pin "2" will be connected to the motor pump relay 159, as described above.

Although the circuit of FIG. 2 was described as being required to receive four not pumped off pulses before it is placed in an enable condition, it is to be understood that it may be employed to require more or less than four of such pulses. This may be done by connecting the inputs to gate G1 to a different Q output pin of counter 411. As an example, the circuit 409 may be employed to require just one not pumped off pulse before it is placed in an enable condition. At least four not pumped off pulses are preferred to insure that the system is responding correctly. If only one not pumped off pulse is required, then block 235 of the flow diagram of FIG. 4 will be eliminated.

In addition, a timer actuated by the first not pumped off pulse may be employed in the circuit of FIG. 2 instead of the not pumped off counter 411. When the timer times out, the transistor 419 will be turned on and the relay 423 energized to close the contacts 425. If such a timer is employed, the flow diagram of FIG. 4 will be modified by substituting for block 235 a timer block, a decision making time complete block, and a timer enable block. The "yes" output of block 235 will be applied to the timer block and its output will be applied to the decision making time complete block. The time complete block will have a "yes" output applied to the enable shut down block 237 and a "no" output applied to the enable timer block. The output of the enable timer block is applied back to the timer block. If the time is complete, the timer will be disabled. If the time is not complete, the timer enable block will maintain the timer enabled.

It is to be understood that the process, as illustrated in FIG. 4 and as described above with its modifications, can also be carried out in a digital computer programmed with soft ware, to control the well pump. In such a system, the transducer will be located at the well as described above as well as the motor control relay 159. The output of the transducer will be amplified and applied to the computer which carries out the process. Its output will be amplified and applied to the motor control relay 159 to shut the pump down or to turn it on as determined by the process. The computer may be located at a distance from the well.

Referring again to FIG. 2, the purpose of gate G2 with a high applied to pin "4" is to provide the customer with the capability of having the circuit 409 ignore the not pumped off counter 411. This can be done by grounding pin "4" to apply a low to this pin. This feature allows the circuit to be compatible with controllers already in the field and which cannot employ the feature of delaying shut down until not pumped off pulses are received. Moreover, the high fluid level problem does not occur in all wells.

When pin "4" is grounded, pin 1 of gate G2 is low and pin 3 of gate G3 is high irregardless of the state of pin 2 of gate G2. The high is applied to pin 13 of gate G3. Thus, the not pumped off counter 411 is ignored. The circuit does not wait for four not pumped off pulses or any prescribed number of such pulses to enable or arm itself. It is continuously armed and any pump off request that is issued will be unconditionally accepted. Thus, the circuit becomes merely a down timer.

Although not shown, provisions preferably are made in the controllers with which circuit 409 is used, for example, the controller of FIG. 3, for handling the situation where the well is shut down due to electrical power failure. Upon reapplication of power to the system, following a power failure, a high fluid level probably will be present in the well. Upon restart up following power failure, the controller will come up in a pumped off condition. Thus, when power is reapplied, the controller will be holding pin "7" of circuit 409 low. The reset timer 413 will issue a reset pulse which will reset the counter 411. Pin Q2 of counter 411 will be low since the counter is in the zero state. Pin 4 of gate G1 will be high and pin "4" also will be high. The highs on pins 1 and 2 of gate G2 insure that its pin 3 is low. Thus, pin 13 of gate G3 will be low whereby its output pin 11 will be high holding transistor 419 in an off state, thus, deenergizing relay 423 resulting in the contacts 425 being open. Thus, the circuit will be disarmed. Even though the controller is holding pin "7" low, which is a pump off request, the circuit is considered disarmed and, thus, ignores the pump off request. The high fluid level in the well will be pumped down whereby the normal fluid level condition will be reached. At this point, the input on pin "7" will go high and positive pulses will be applied to pin "8". The system will be enabled when four not pumped off pulses are received.

Figure 5:
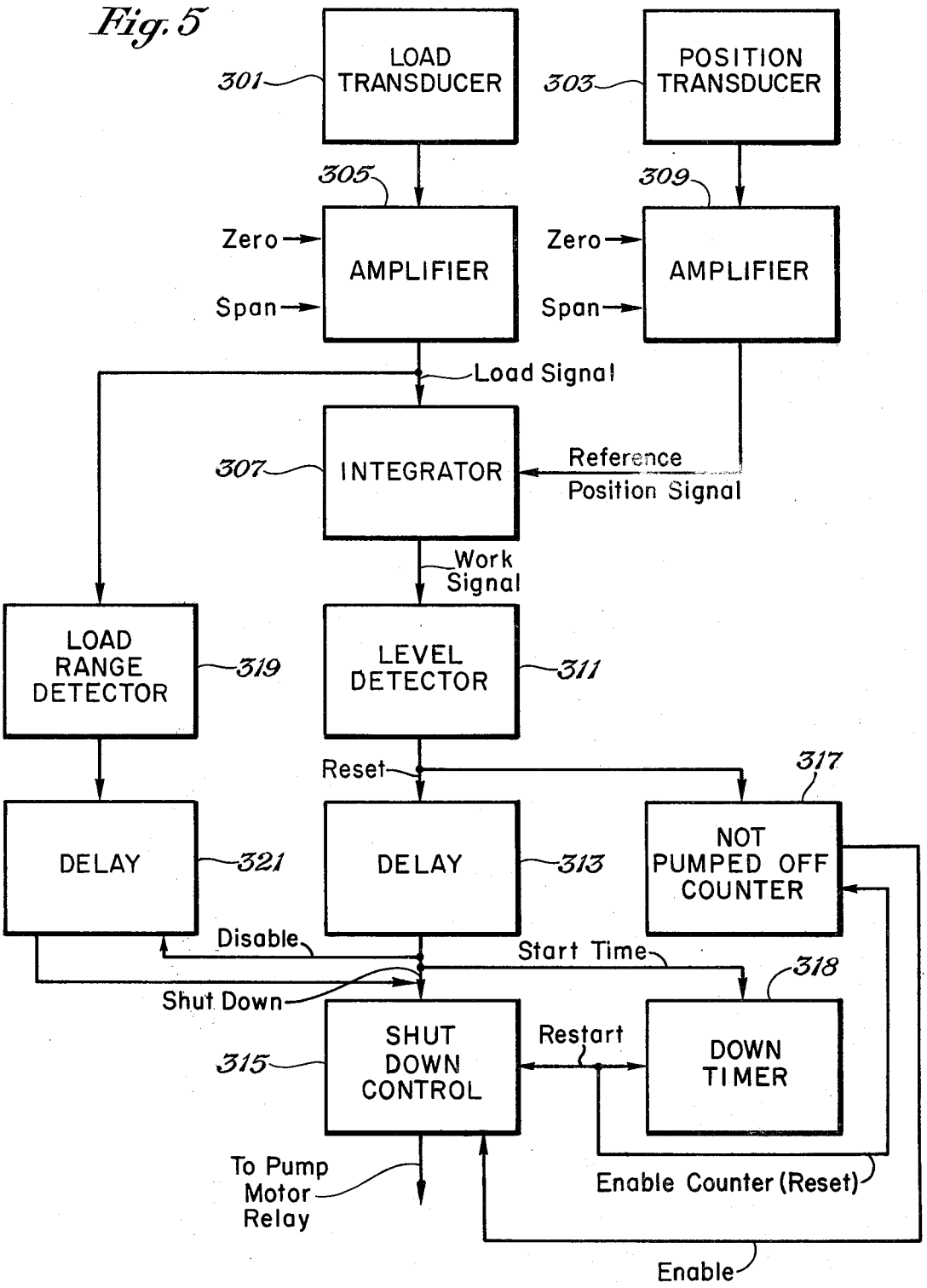

Referring now to FIG. 5, there will be described another embodiment of the process and system of the present invention. Reference numeral 301 identifies a load transducer which may be located on the polished rod of the pump although it could be located on the walking beam. A position transducer 303 is provided for measuring the walking beam position. The output of transducer 301 is amplified at 305 and applied to an integrator 307. The output of transducer 303 is amplified at 309 and applied to integrator 307 where it is used as a reference. The integrator 307 integrates pump load with respect to beam position. Integration may be carried out over only a portion of each stroke cycle. The output of integrator 307 is applied to a level detector 311. When the integrated output of integrator 307 reaches a preset level each cycle, determined by level detector 311, a logic one or positive pulse is produced by the detector 311. An integrated output above the preset level indicates that the pump is pumping normally. If the integrated output does not reach the preset level, the work done by the pump has decreased due to a high fluid level or due to a pumped off condition and a logic one is not produced by detector 31. The logic one, when produced resets a timing circuit of delay 313 which inhibits shut down by shut down control 315. The logic one also is applied to the not pumped off counter 317. When counter 317 has counted a prescribed number of counts, it enables the shut down control 315. Enabling may be carried out by energizing a relay to close its contacts to provide a current flow path to the pump motor relay 159 as described in connection with FIG. 2. After shut down control 315 is enabled the well can be shut in due to a pumped off condition. Thus, if a logic one now is not produced due to pump off, the timer of delay 313 is not reset and a shut down control signal produced by control 315 is allowed to pass to the motor pump relay to shut down the pump motor. When the timer of delay 313 is not reset, a start down time signal is applied to down timer 318. When the down timer 318 times out, a restart signal is applied to disable the shut down control 315 to restart the pump motor. This restart signal also is applied back to reset the not pumped off counter 317 back to zero. Blocks 319 and 321 comprise a malfunction circuit. Until the shut down control 315 is enabled, the pump cannot be shut down.

As can be understood, the process and system of FIG. 5 requires a not pumped off condition to be detected before the pump can be shut down due to a pumped off condition.

The process as described with respect to FIG. 5 can be carried out in a digital computer or by an analog system. If a computer is used, its inputs will be the outputs of amplifiers 305 and 309 and its output will be the output of shut down control 315.

Figure 6:
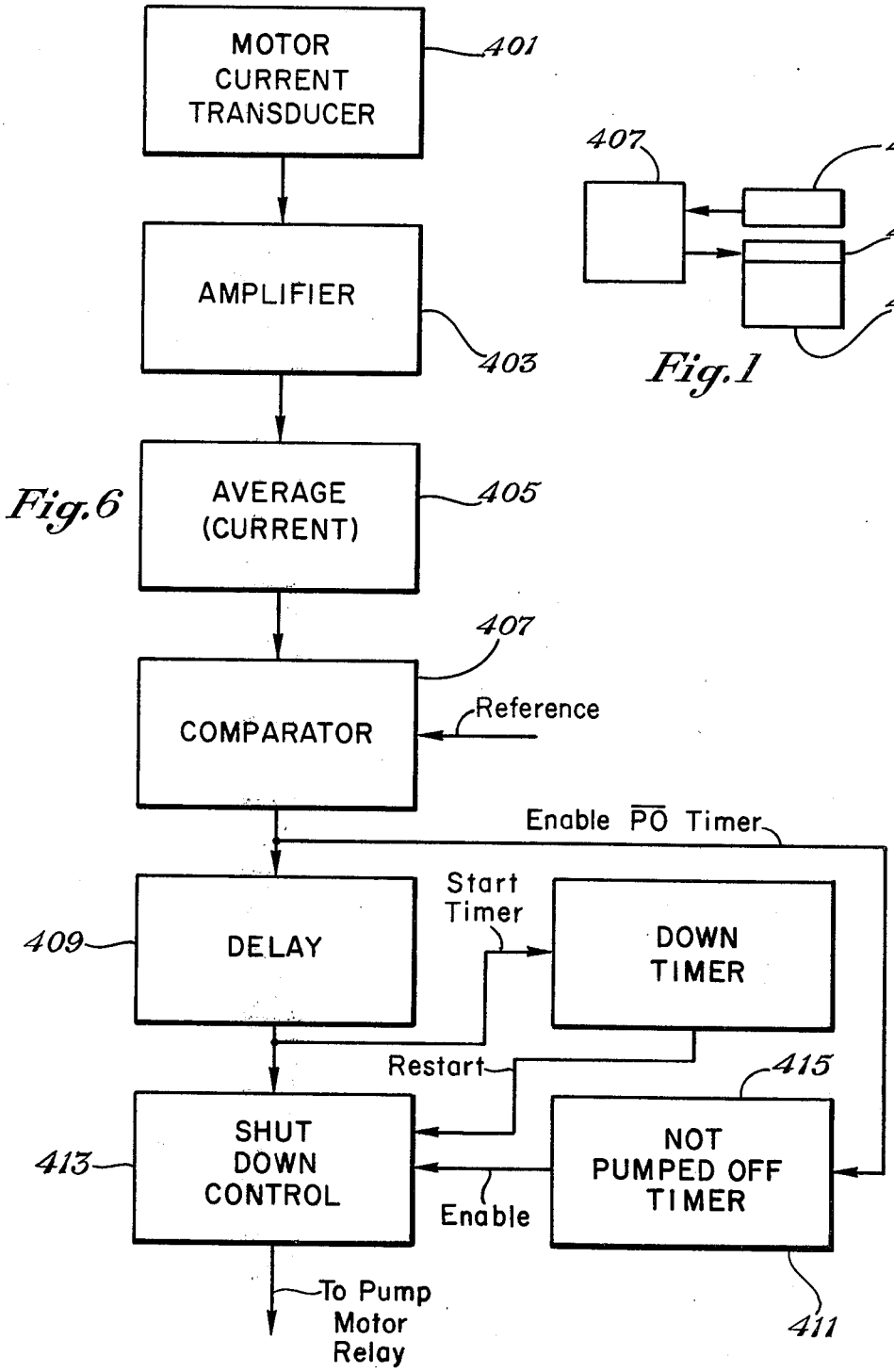
FIGS. 5 and 6 are block diagrams of other embodiments of the process and system of the present invention.

FIG. 6 illustrates another embodiment of the process and system of the present invention. In this embodiment, reference numeral 401 identifies a transducer for measuring motor current. Its output is amplified at 403 and applied to an averaging (integrator) circuit 405 which averages the current over a number of pump stroke cycles. The output of circuit 405 is applied to a comparator 407 which compares the average with a given reference level. If the average current is above the reference level, the well is considered to be in a not pumped off condition. When the work done by the pump decreases, the average motor current also decreases. When it falls below the preset level, the well is in a pumped off condition or has a high fluid level. If the average current is above the reference level, a high output is produced by the comparator 407. This high is applied to a delay circuit 409 to prevent a timer from timing. It is also applied to a not pumped off timer 411 to allow it to begin timing. When the timer 411 times out, it enables a shut down control 413. Enabling may be carried out by energizing a relay to close its contacts to provide a current flow path to the pump motor relay as described in connection with FIG. 2. After the control 413 has been enabled, the well can be shut down due to a pumped off condition. When this occurs, comparator 407 does not produce a high and the timer of delay 409 is allowed to start timing to cause the shut down control 413 to produce a shut down control signal. This signal is allowed to pass to the motor pump relay to shut down the pump motor. When the timer of delay 409 starts timing, a start down timer signal is applied to a down timer 415. When the down timer 415 times out, a restart signal is applied to disable the shut down control 413 to restart the pump motor. Until shut down control 413 is enabled, the pump cannot be shut down. Thus, as can be understood, the process and system of FIG. 6 requires a not pumped off condition to be detected before the pump can be shut down due to a pumped off condition. The process can be carried out in a digital computer or by an analog system. If a computer is used, its input will be the output of amplifier 403 and its output will be the output of shut down control 413.

Referring again to FIG. 2, reference numeral 420 identifies a L.E.D. which is energized when coil 421 of relay 423 is energized.

What is claimed is:

1. A method of controlling the pump of a well employed for pumping fluid from a borehole to the surface, wherein a control means is employed for controlling the operation of said pump, said method comprising the steps of:

producing a signal which is a function of the work performed by said pump during its operation, placing said control means in an enable condition capable of shutting down said pump only if said signal reaches a given threshold representative of a given condition of said well, and after said control means has been placed in said enable condition, causing said control means to shut down said pump if said signal does not reach said given threshold.

2. A method of controlling the pump of a well employed for pumping fluid from a borehole to the surface, wherein a control means is employed for controlling the operation of said pump, said method comprising the steps of:

sensing a parameter which varies with the operation of said pump, from said parameter sensed, producing a signal which is a function of the work performed by said pump during its operation, placing said control means in an enable condition capable of shutting down said pump only if said signal reaches a given threshold representative of a given condition of said well, and after said control means has been placed in said enable condition, causing said control means to shut down said pump if said signal does not reach said given threshold.

3. A method of controlling the pump of a well employed for pumping fluid from a borehole to the surface, wherein a control means is employed for controlling the operation of said pump, said control means being of the type that must be enabled before it can shut down said well pump, said method comprising the steps of:

employing a sensing means for sensing a parameter which varies with the operation of said pump, from said parameter sensed, produced a signal which is a function of the work performed by said pump during its operation, enabling said control means to place said control means in a condition capable of shutting down said pump only if said signal reaches a given threshold representative of a given condition of said well, and after said control means has been enabled, causing said control means to shut said pump down of said signal does not reach said given threshold.

4. A method of controlling an electric motor employed for driving a walking beam type pump used for pumping fluid from a well comprising the steps of:

starting said motor, sensing a parameter which varies with the operation of said pump during each stroke cycle of the walking beam, from said parameter sensed, producing a signal which is a function of the work performed by said pump during each stroke cycle, comparing said signal with a given threshold, if said signal produced after start up of said motor initially is below said threshold, preventing the shut down of said motor until said signal reaches said threshold, after said signal reaches said threshold, shutting down said motor if said signal subsequently does not reach said threshold.

5. A method of controlling the pump of a well employed for pumping fluid from a borehole to the surface comprising the steps of:

starting said pump, producing a signal which is a function of the work performed by said pump during its operation, comparing said signal with a given threshold, if said signal produced after start up of said pump initially is below said threshold, preventing the shut down of said pump until said signal reaches said threshold, after said signal reaches said threshold, shutting down said pump if said signal subsequently does not reach said threshold.

6. A method of controlling the pump of a well employed for pumping fluid from a borehole to the surface comprising the steps of:

starting said pump, producing a signal having a first characteristic if the work performed by said pump is above a given value and a second characteristic if the work performed by said pump is below said given value, determining if said signal has said first or second characteristic, and if said signal produced after start up of said pump initially has said second characteristic, preventing the shut down of said pump until said signal takes on said first characteristic prior to taking on said second characteristic, if said signal takes on said second characteristic after first taking on said first characteristic, shutting down said pump.

7. A method of controlling the pump of a well employed for pumping fluid from a borehole to the surface comprising the steps of:

starting said pump, determining whether the work performed by said pump is above or below a given value, if the work performed by said pump initially is below said given value, preventing the shut down of said pump until the work performed by said pump increases above said given value, after the work performed by said pump increases above said given value, shutting down said pump if the work performed by said pump subsequently decreases below said given value.

8. A system for controlling the pump of a well employed for pumping fluid from a borehole to the surface, comprising:

control means for controlling the operation of said pump, said control means being of the type that must be enabled before it can shut down said pump, signal producing means for producing a signal having a first characteristic if the work performed by said pump is above a given value and a second characteristic if the work performed by said pump is below said given value, means for enabling said control means to place said control means in a condition capable of shutting down said pump only after said signal takes on said first characteristic, and means for applying a control signal to said control means for shutting said pump down after said control means has been enabled and if said signal takes on said second characteristic.

* * * * *